US006855031B2

(12) United States Patent
Fuksshimov et al.

(10) Patent No.: US 6,855,031 B2
(45) Date of Patent: Feb. 15, 2005

(54) SLURRY FLOW RATE MONITORING IN CHEMICAL-MECHANICAL POLISHER USING PRESSURE TRANSDUCER

(75) Inventors: Boris Fuksshimov, San Jose, CA (US); Jeff P Rudd, San Jose, CA (US); Charles C Garretson, San Jose, CA (US); Brian J Brown, Palo Alto, CA (US)

(73) Assignee: Applied Materials, Inc., Santa Clara, CA (US)

( * ) Notice: Subject to any disclaimer, the term of this patent is extended or adjusted under 35 U.S.C. 154(b) by 54 days.

(21) Appl. No.: 10/360,558

(22) Filed: Feb. 7, 2003

(65) Prior Publication Data

US 2003/0166378 A1 Sep. 4, 2003

Related U.S. Application Data

(60) Provisional application No. 60/355,092, filed on Feb. 8, 2002.

(51) Int. Cl.[7] ..... B24B 49/00; B24B 51/00

(52) U.S. Cl. ..... 451/5; 137/12; 451/8; 451/60; 451/99; 451/446

(58) Field of Search ..... 137/2, 12, 551; 222/71; 451/99, 5, 8, 36, 41, 60, 446

(56) References Cited

U.S. PATENT DOCUMENTS

| | | | | | |
|---|---|---|---|---|---|
| 4,492,248 | A | * | 1/1985 | Aude | 137/236.1 |
| 5,692,947 | A | | 12/1997 | Talieh et al. | |
| 5,693,887 | A | | 12/1997 | Englund et al. | |
| 5,852,244 | A | * | 12/1998 | Englund et al. | 73/706 |
| 5,857,893 | A | * | 1/1999 | Olsen et al. | 451/5 |
| 6,149,508 | A | * | 11/2000 | Vanell et al. | 451/72 |
| 6,183,341 | B1 | * | 2/2001 | Melcer | 451/5 |

* cited by examiner

*Primary Examiner*—Timothy V. Eley
(74) *Attorney, Agent, or Firm*—Dugan & Dugan

(57) ABSTRACT

In a first aspect of the invention, a polishing device is provided. The polishing device includes a platen adapted to support a polishing pad and also includes a source of polishing slurry. Also included in the polishing device is a slurry supply line adapted to supply the polishing slurry from the source of polishing slurry to the polishing pad. The polishing device includes a pressure transducer installed along the slurry supply line and adapted to detect a pressure inside the slurry supply line. Numerous other aspects are provided.

14 Claims, 2 Drawing Sheets

SLURRY FLOW RATE MONITORING IN CHEMICAL-MECHANICAL POLISHER USING PRESSURE TRANSDUCER

This application claims priority from pending provisional patent application Ser. No. 60/355,092, filed Feb. 8, 2002, the content of which is hereby incorporated by reference herein in its entirety.

FIELD OF THE INVENTION

The present invention relates to the field of semiconductor processing, and more particularly to an apparatus for polishing and/or planarizing semiconductor wafers and the thin films formed thereon.

BACKGROUND OF THE INVENTION

Semiconductor devices are formed on silicon substrates and are typically multi-layered, having numerous metalization layers separated by numerous insulating oxides and interconnected with vias or contact holes. For instance, an interconnect for a typical multi-layer device is formed by depositing and patterning a first metal layer over the device, depositing an intermediate oxide over the patterned first metal layer, photolithographically defining a contact hole in the oxide, and depositing a second metal layer over the oxide that fills the contact hole and contacts the patterned first metal layer.

Often undesirable steps or undulations must be removed from the silicon substrate or from one of the metal or oxide layers before another layer can be formed thereon. To remove steps or undulations, the silicon oxide or metal is preferably planarized, removing any steps or undulations formed therein, prior to deposition of a layer thereon. Planarization is typically performed mechanically by forcing the semiconductor wafer face down against a polishing pad which is saturated with a polishing slurry, and by moving the polishing pad relative to the wafer. The relative movement between the polishing pad and the wafer, combined with the polishing slurry chemically and mechanically removes layers of material and is continued until the steps or undulations are removed. This process is generally referred to as chemical mechanical polishing (CMP).

Suitable performance of CMP generally requires that an appropriate amount of polishing slurry be delivered to the polishing pad. For example, film removal rates are strongly dependent on the amount of slurry dispensed. However, slurry dispensing rates often vary due to fluctuations in facility slurry supply pressures (e.g., at the tool inlet). To aid in metering the flow of polishing slurry so that an appropriate amount is delivered to the polishing pad, it has been proposed to detect the flow rate of the polishing slurry in a slurry supply line. However, previously proposed techniques for detecting the rate of flow of polishing slurry may lead to clogging of the slurry supply line and/or may create shear in the flow of polishing slurry, thereby resulting in particle agglomeration within the slurry. This, in turn, may lead to micro-scratching of the wafer during CMP, resulting in lower device yields.

SUMMARY OF THE INVENTION

In a first aspect of the invention, a polishing device is provided. The polishing device includes a platen adapted to support a polishing pad and also includes a source of polishing slurry. Also included in the polishing device is a slurry supply line adapted to supply the polishing slurry from the source of polishing slurry to the polishing pad. The polishing device includes a pressure transducer installed along the slurry supply line and adapted to detect a pressure inside the slurry supply line (i.e., not a differential pressure measurement).

The pressure transducer provides an output signal that is directly proportional to the rate of flow of the polishing slurry in the slurry supply line. The pressure transducer may not interfere with the flow of slurry within the slurry supply line, and therefore may not be prone to clogging or producing particle agglomeration that may result in device defects. Preferably the pressure transducer will impart little or no shear force to the slurry flow.

DETAILED DESCRIPTION OF A PREFERRED EMBODIMENT

In a polishing device provided in accordance with the invention, a pressure transducer may be provided along a slurry supply line to measure a rate of flow of slurry in the supply line. Thus the pressure transducer may not restrict or otherwise interfere with the flow of slurry in the supply line, and accordingly may avoid agglomeration of particles within the slurry.

Figure 1:
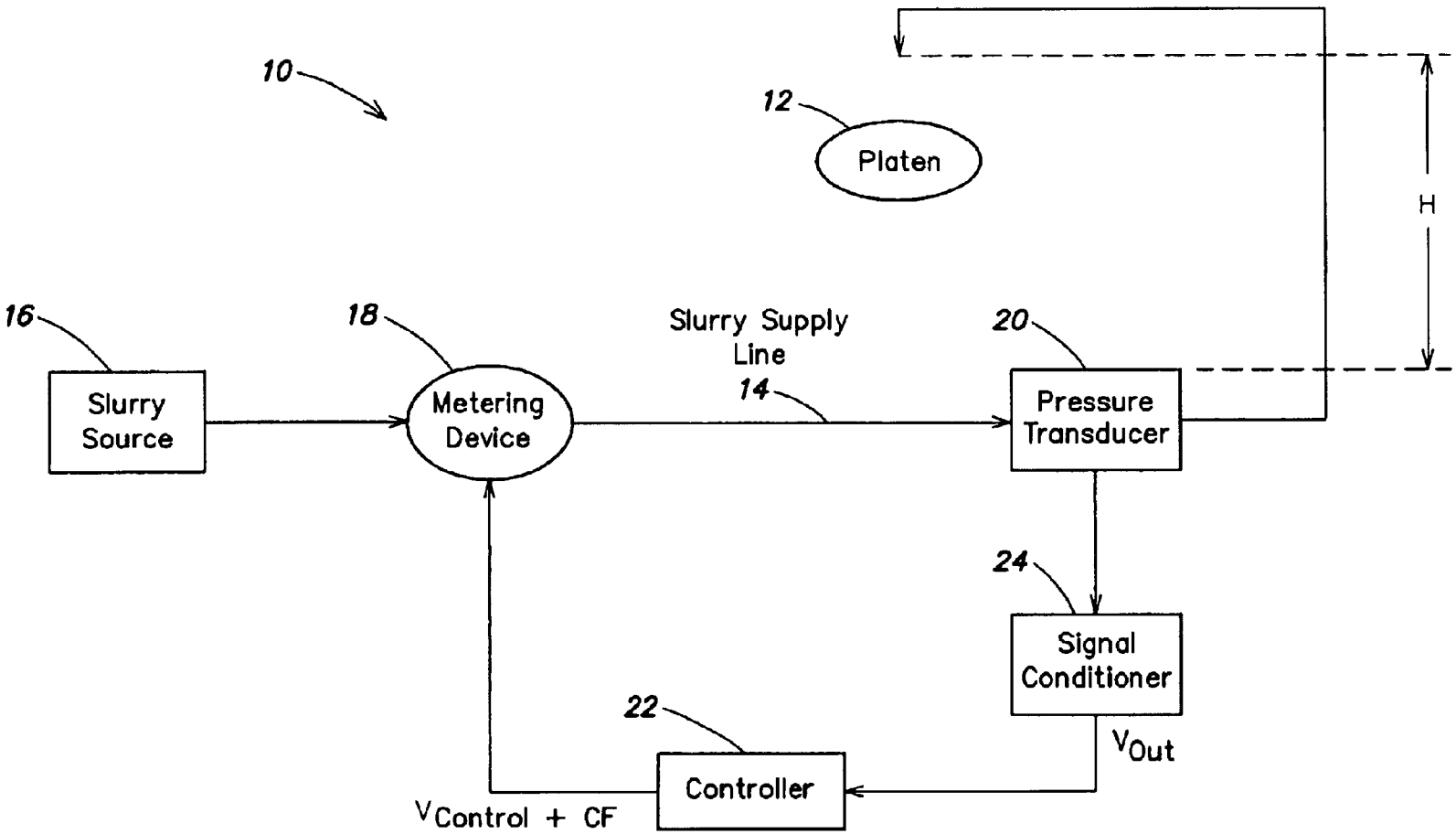
FIG. 1 is a schematic side view of a polishing device provided in accordance with the invention.

FIG. 1 is a schematic side view of an embodiment of an inventive chemical mechanical polishing device 10. The polishing device 10 includes a platen 12 on which a polishing pad (not separately shown) is mounted for rotation. A semiconductor wafer (not shown) is held face down on the polishing pad so as to be polished by the polishing pad. A slurry supply line 14 supplies polishing slurry to the platen 12, specifically to the polishing pad mounted thereon, from a polishing slurry source 16. A flow metering device 18 is provided on the slurry supply line 14 downstream from the slurry source 16 to control the rate of flow of polishing slurry within the slurry supply line 14. The flow metering device 18 may be of a type conventionally employed in chemical mechanical polishing devices.

In accordance with the invention, a pressure transducer 20 is installed along the slurry supply line 14 downstream from the flow metering device 18. A controller 22 is coupled to both the flow metering device 18 and the pressure transducer 20. If desired, a signal conditioner 24 such as an amplifier, filter or the like may be employed to appropriately condition the output of the pressure transducer 20 fed to the controller 22 (as described below). An exemplary device that is suitable for use as the pressure transducer 20 is a model no. 4210-15-F02-B06-T-20 15 psi/5v pressure transducer manufactured by NT. Other pressure transducers also may be employed. The controller 22 may comprise any conventional controller such as a microprocessor, a microcontroller, a dedicated hardware circuit, a combination thereof or the like.

The pressure in the slurry supply line 14 is a function of (a) properties of the slurry supply line 14 and (b) the flow rate of slurry through the slurry supply line 14. The properties of the slurry supply line which affect line pressure are inside diameter, length, shape, and the height (H) above the pressure transducer 20 at which the slurry is dispensed to the polishing pad. Because the properties of the slurry supply line 14 are fixed, it follows that the line pressure varies directly with the flow rate of the slurry within the slurry supply line 14. Consequently, the pressure reading that is output from the pressure transducer 20 reflects the rate of flow of the slurry in the slurry supply line 14.

Figure 2:
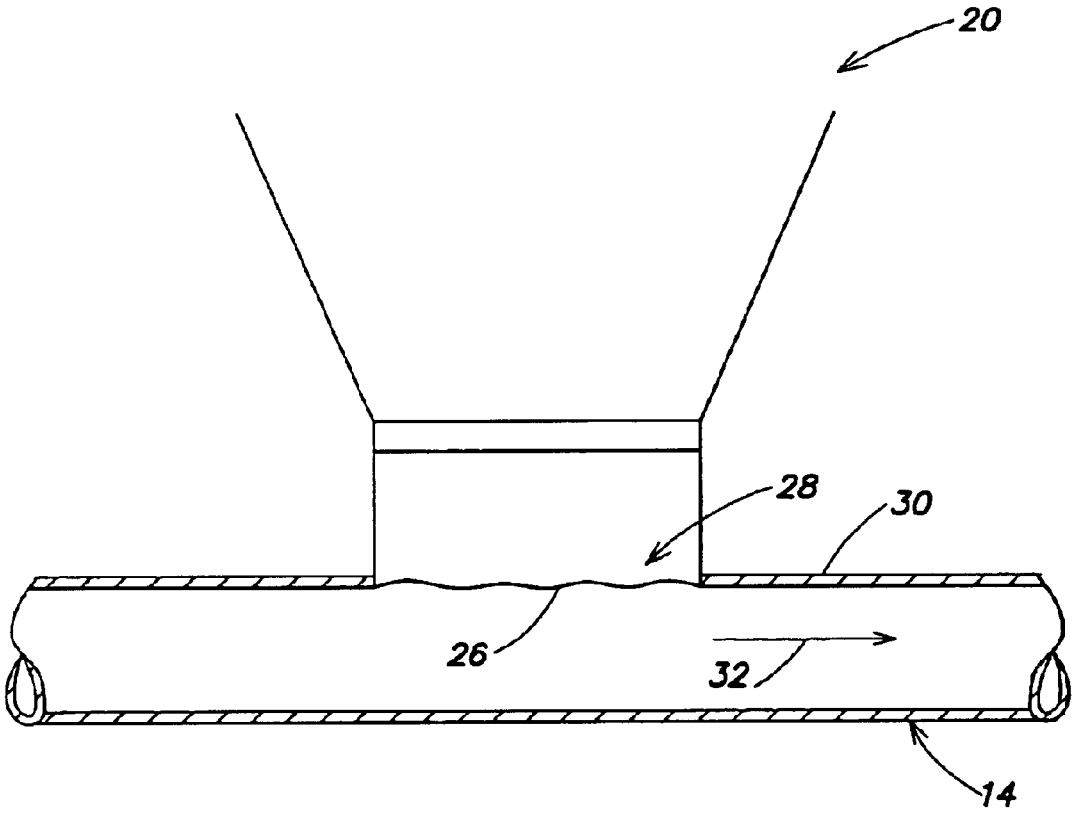
FIG. 2 is a schematic side view of an exemplary embodiment of the invention, showing a pressure transducer coupled to a slurry supply line.

The pressure transducer 20 may operate by detecting pressure against a membrane that preferably does not interfere with the flow of slurry in the slurry supply line 14 or does so only to a slight extent. For example, FIG. 2 is a schematic side view of an exemplary embodiment of the pressure transducer 20 coupled along the slurry supply line 14. The pressure transducer 20 of FIG. 2 includes a membrane 26 that covers an opening 28 in the slurry supply line 14 and that detects slurry pressure within the slurry supply line 14. The distance between the membrane 26 and a wall 30 of the slurry supply line 14 that contains the opening 28 preferably is minimized (e.g., to reduce and/or eliminate shear forces within the flow of slurry (indicated by arrow 32 in FIG. 2), due to the presence of the pressure transducer 20 and/or opening 28). Most preferably, the membrane 26 is flush with the inner surface of the slurry supply line 14. This is preferable to a differential pressure sensing device of the type which detects a pressure drop across a critical orifice, since the orifice may be subject to clogging and may create shear in the flow of slurry, possibly resulting in particle agglomeration, micro-scratching of the wafer during polishing, and lower device yields.

Furthermore, the pressure transducer 20 operates "in-line" with the slurry supply line 14 and does not require changes in the direction of the flow of slurry as is required by flow detecting techniques such as those that employ a paddle wheel or an ultrasonic flow detection mechanism. Changes in the direction of flow required by these other techniques may create shear in the flow of slurry, possibly resulting in particle agglomeration and micro-scratching of the wafer during polishing. The pressure transducer 20 used in the inventive polishing device 10 does not include a critical orifice, and does not require changes in the direction of flow of the slurry in the slurry supply line 14, thereby avoiding the problems that may be caused by other flow measurement techniques.

In operation, a wafer, which is not shown, is presented to the polishing pad (also not shown) installed on the platen 12 and relative motion is provided between the wafer and the polishing pad. A flow of polishing slurry is provided from the slurry source 16 to the polishing pad via the slurry supply line 14. The flow metering device 18 controls the rate of flow of the slurry within the slurry supply line 14, and the rate of flow of slurry (as controlled by the flow metering device 18) may be set via a control signal ($V_{CONTROL}$) provided by the controller 22 to the flow metering device 18. For example, an operator (not shown) may direct the controller 22 to set a flow rate of slurry to the polishing pad at a predetermined set point flow rate, and the controller 22 may generate the appropriate control signal ($V_{CONTROL}$) needed to direct the flow metering device 18 to set the flow rate at the set point flow rate.

A pressure output reading ($V_{OUT}$) from the pressure transducer 20 is indicative of the rate of flow of slurry within the slurry supply line 14 and is fed to the controller 22. Based on the pressure output reading ($V_{OUT}$) of the pressure transducer 20, the controller 22 determines if the flow rate of slurry measured by the pressure transducer 20 (e.g., the actual flow rate) matches the set point flow rate (e.g., the desired flow rate). If the pressure output reading ($V_{OUT}$) of the pressure transducer 20 indicates that the flow rate of slurry is other than the set point flow rate, the controller 22 may adjust the control signal ($V_{CONTROL}$) output to the flow metering device 18 by a correction factor (CF) (e.g., to adjust the actual flow rate of slurry back to the set point flow rate). In at least one embodiment of the invention, if the flow rate of slurry measured by the pressure transducer 20 drops below a predetermined threshold (or otherwise falls outside of a predetermined range), an alarm or other signal may be generated (e.g., to notify an operator of the same).

The foregoing description discloses only a preferred embodiment of the invention; modifications of the above disclosed apparatus which fall within the scope of the invention will be readily apparent to those of ordinary skill in the art.

Although the invention is described with reference to a horizontally oriented rotational polishing device, the invention advantageously may be employed with any polishing device including vertically oriented polishers and/or polishers which employ translating polishing pads or conveyor-type polishing bands such as that described in U.S. Pat. No. 5,692,947. Further, although the invention does not require changes in slurry flow direction or inclusion of restrictive orifices, the pressure transducer 20 may be employed with an existing slurry supply line which may or may not include changes in direction and restricted orifices.

Accordingly, while the present invention has been disclosed in connection with preferred embodiments thereof, it should be understood that other embodiments may fall within the spirit and scope of the invention, as defined by the following claims.

The invention claimed is:

1. A polishing device comprising:

a platen adapted to support a polishing pad;

a source of polishing slurry;

a slurry supply line adapted to supply the polishing slurry from the source of polishing slurry to a polishing pad supported by the platen;

a flow metering device provided on the slurry supply line located downstream of the source of polishing slurry, wherein the flow metering device controls the rate of flow of the polishing slurry within the slurry supply line; and a pressure transducer installed along the slurry supply line located downstream of the flow metering device and downstream of the source of polishing slurry, wherein the pressure transducer is adapted to detect a pressure inside the slurry supply line, at a location in the slurry supply line downstream from the flow metering device.

2. The polishing device of claim 1 wherein the pressure transducer is installed in line with a flow of slurry, and does not change a direction of the slurry flow.

3. The polishing device of claim 1 wherein the pressure transducer is adapted so as to impart minimal shear to a flow of slurry that flows through the slurry supply line.

4. The polishing device of claim 3 wherein the slurry supply line is adapted so as to allow the pressure transducer to be mounted so as to be flush with an inner surface of the slurry supply line, and wherein the pressure transducer is installed so as to be flush with the inner surface of the slurry supply line.

5. The polishing device of claim 1 wherein the pressure transducer is adapted to provide an output signal that is directly proportional to a rate of flow of slurry in the slurry supply line.

6. The polishing device of claim 1 further comprising a controller coupled to both the flow metering device and the pressure transducer so as to receive a signal from the pressure transducer and so as to transmit a signal to the flow metering device to thereby control the rate of polishing slurry flow through the slurry supply line, wherein the controller is adapted to adjust the signal transmitted to the flow metering device, based on the signal received from the pressure transducer.

7. The polishing device of claim 6 wherein the pressure transducer is adapted to provide an output signal that is directly proportional to a rate of flow of slurry in the slurry supply line.

8. The polishing device of claim 6 wherein the controller is adapted so as to cause a desired slurry flow rate to be achieved.

9. The polishing device of claim 6 wherein the controller is further adapted to generate a warning signal when the rate of polishing slurry flow through the slurry supply line is not a desired flow rate.

10. A method of measuring a flow rate of a polishing slurry, comprising:

providing a polishing slurry supply line;

installing a flow metering device on the polishing slurry supply line located downstream of a source of polishing slurry, wherein the flow metering device controls the rate of flow of the polishing slurry within the polishing slurry supply line;

installing a pressure transducer within the polishing slurry supply line downstream of the flow metering device and downstream of the source of polishing slurry;

flowing polishing slurry through the polishing slurry supply line;

measuring a pressure exerted on the pressure transducer by the polishing slurry at a location in the slurry supply line downstream from the flow metering device; and determining a flow rate of the polishing slurry based on the pressure exerted on the pressure transducer.

11. The method of claim 10 wherein flowing polishing fluid through the polishing slurry supply line comprises flowing the polishing slurry in line with the pressure transducer.

12. The method of claim 10 further comprising adjusting a flow rate of the polishing slurry based on the measured pressure exerted on the pressure transducer.

13. The method of claim 12 further comprising sending a warning signal when the flow rate of polishing slurry is not a desired flow rate.

14. The method of claim 10 further comprising sending a warning signal when the flow rate of polishing slurry is not a desired flow rate.

* * * * *